US008797607B2

(12) United States Patent
Hayashihara et al.

(10) Patent No.: US 8,797,607 B2
(45) Date of Patent: Aug. 5, 2014

(54) METHOD AND APPARATUS FOR DECIDING RECORDING MEDIA BASED ON LIGHT FROM A LINEAR LIGHT SOURCE THAT PASSES A SLIT IN A LIGHT SHIELDING PORTION

(75) Inventors: Hiromichi Hayashihara, Kanagawa (JP); Masataka Shiratsuchi, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 455 days.

(21) Appl. No.: 13/167,667

(22) Filed: Jun. 23, 2011

(65) Prior Publication Data

US 2012/0257259 A1 Oct. 11, 2012

(30) Foreign Application Priority Data

Apr. 8, 2011 (JP) ..... 2011-086311

(51) Int. Cl.
*H04N 1/40* (2006.01)

(52) U.S. Cl.
USPC ..... 358/449; 358/474; 358/1.13; 358/1.15; 399/45; 399/389; 271/10.01; 271/96; 271/97; 271/98; 356/630; 356/632

(58) Field of Classification Search
None
See application file for complete search history.

(56) References Cited

U.S. PATENT DOCUMENTS

| | | | | |
|---|---|---|---|---|
| 6,636,704 | B2 | 10/2003 | Weaver et al. | |
| 7,663,769 | B2 | 2/2010 | Hayashihara et al. | |
| 7,677,764 | B2 * | 3/2010 | Lin | 362/283 |
| 8,336,870 | B2 * | 12/2012 | Kobayashi | 271/10.01 |
| 2003/0128399 | A1 * | 7/2003 | Chino et al. | 358/296 |
| 2009/0086217 | A1 * | 4/2009 | Hayashihara et al. | 356/630 |
| 2010/0310264 | A1 * | 12/2010 | Ishida et al. | 399/45 |
| 2011/0116058 | A1 * | 5/2011 | Ota et al. | 355/22 |
| 2012/0002227 | A1 * | 1/2012 | Ogino | 358/1.12 |

FOREIGN PATENT DOCUMENTS

| | | |
|---|---|---|
| CN | 101898235 | 4/2009 |
| JP | 07-196207 | 8/1995 |
| JP | 2003-081486 | 3/2003 |
| JP | 2003226447 | 8/2003 |
| JP | 2005-104723 | 4/2005 |
| JP | 2009-096638 | 5/2009 |
| JP | 2010-189137 | 9/2010 |
| WO | 2010095683 | 8/2010 |

OTHER PUBLICATIONS

Office Action dated Apr. 16, 2014, filed in Chinese Application No. 201110180026.5, with English translation.

* cited by examiner

*Primary Examiner* — Miya J Cato
(74) *Attorney, Agent, or Firm* — Patterson & Sheridan LLP

(57) ABSTRACT

A recording media deciding apparatus has: a light radiating portion which radiates light having a uniform light amount on a range corresponding to an image capturing range of a first surface of a bundle of recording media; a light detecting portion which captures an image of light emitted from a second surface different from the first surface of the bundle of the recording media; and a controller which decides on a type of the recording media based on an output of the light detecting portion.

20 Claims, 12 Drawing Sheets

Fig. 7

| TYPE OF RECORDING MEDIA | THICKNESS (mm) | DENSITY ($g/cm^3$) | TRANSMISSION LIGHT ATTENUATION RATE |
|---|---|---|---|
| PLAIN PAPER 1 | A11～A12 | B11～B12 | C11～C12 |
| PLAIN PAPER 2 | A21～A22 | B21～B22 | C21～C22 |
| THICK PAPER A1 | A31～A32 | B31～B32 | C31～C32 |
| THICK PAPER A2 | A41～A42 | | |
| THICK PAPER B1 | A51～A52 | B41～B42 | C41～C42 |
| THICK PAPER B2 | A61～A62 | | |

Fig. 8

| TYPE OF RECORDING MEDIA | FIXING TARGET TEMPERATURE (° C) | CONVEYING SPEED (mm/s) |
|---|---|---|
| PLAIN PAPER 1 | D11～D12 | E11～E12 |
| PLAIN PAPER 2 | D21～D22 | |
| THICK PAPER A1 | D31～D32 | E21～E22 |
| THICK PAPER A2 | D41～D42 | |
| THICK PAPER B1 | D51～D52 | E31～E32 |
| THICK PAPER B2 | D61～D62 | |

- Prior Art -

- Prior Art -

METHOD AND APPARATUS FOR DECIDING RECORDING MEDIA BASED ON LIGHT FROM A LINEAR LIGHT SOURCE THAT PASSES A SLIT IN A LIGHT SHIELDING PORTION

CROSS-REFERENCE TO RELATED APPLICATIONS

This application is based upon and claims the benefit of priority from the prior the Japanese Patent Application No. 2011-086311, filed on Apr. 8, 2011, and the entire contents of which are incorporated herein by reference.

FIELD

The present invention relates to a recording media deciding apparatus, an image forming apparatus and a recording media deciding method.

BACKGROUND

An image forming apparatus, such as a copying machine, MFP or printer, forms images on recording media. The recording media include a plurality of types of recording media such as cardboards, plain paper and OHP films.

To form high quality images, the image forming apparatus optimizes conditions of an image forming method and fixing method according to the type of recording media. Therefore, information related to the type of the recording media, for example, information such as the type, thickness and density of the recording media, is required.

A conventional image forming apparatus has sensors, such as an optical sensor and thickness sensor for deciding the type of the recording media, between a recording media supplying unit arranged in a conveying path of recording media and the image forming portion. The image forming apparatus of this type supplies recording media from the recording media supplying unit and decides on the type of the recording media while the recording media are conveyed.

However, if the type of recording media is decided after the recording media are supplied from the recording media supplying unit, some image forming apparatuses cannot optimize the conditions of the image forming method and fixing method in time.

In this regard, a technique is proposed, in which light on the bundle of recording media stacked in the recording media supplying unit is radiated in order to let the light in the bundle, an image of light leaking from between these stacked recording media is captured by means of an area sensor, and the thickness and density of the recording media is measured based on contrast of the obtained image and a change of a light intensity, that is, the attenuation rate of the light in the recording media in a radiating direction.

However, when point light sources such as round type LEDs are used for the light sources for radiating light toward recording media, unevenness of the light intensity is produced in a detection area of an area sensor. This unevenness of the light intensity limits precision to decide on the type of recording media.

Hence, a recording media deciding apparatus, image forming apparatus and recording media deciding method which can more precisely decide on the type of recording media when the recording media are in the recording media supplying unit are required.

BRIEF DESCRIPTION OF THE DRAWINGS

FIG. 7 is a view illustrating a data configuration of a type information database.

FIG. 8 is a view illustrating a data configuration of a fixing parameter database.

DETAILED DESCRIPTION

Throughout this description, the embodiments and examples shown should be considered as exemplars, rather than limitations on the apparatus and methods of the present embodiments.

Hereinafter, embodiments of a recording media deciding apparatus, image forming apparatus and recording media deciding method will be described in detail using some drawings. Here, the image forming apparatus includes copying machines, MFPs (Multifunction Peripherals) and printers.

The image forming apparatus according to the embodiments of the present invention has a recording media supplying unit which supplies recording media, a recording media conveying mechanism which conveys the recording media supplied from the recording media supplying unit, an image forming portion which forms images on the recording media, alight radiating portion which radiates light on the first surface of the bundle of the recording media, a light detecting portion which captures an image of light radiated on a range corresponding to an image capturing range by the light radiating portion and emitted from the second surface different from the first surface of the bundle of the recording media, and a controller which decides on the type of the recording media based on an output from the light detecting portion.

(Overview of Image Forming Apparatus)

Figure 1:
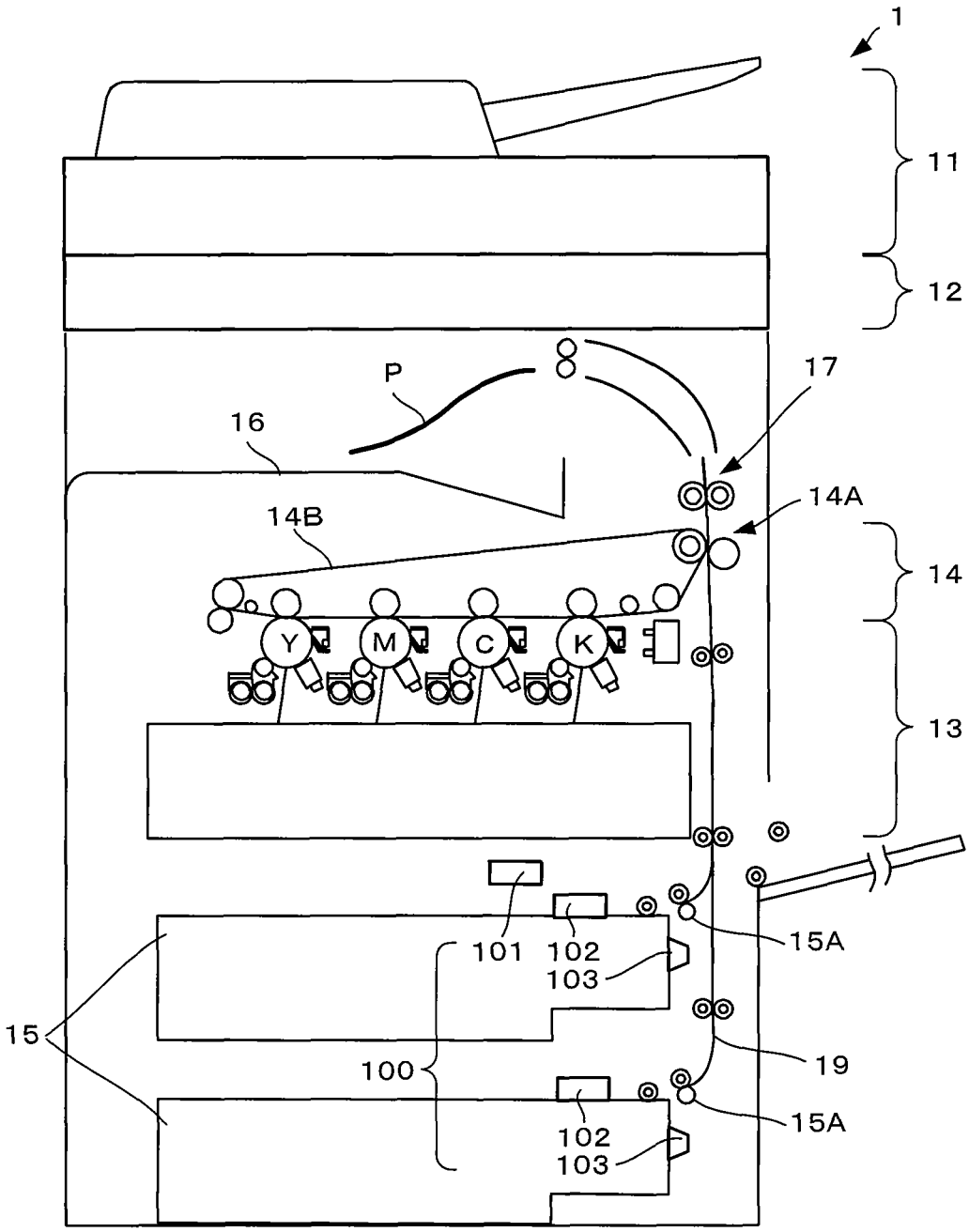
FIG. 1 is a side view of an image forming apparatus including a recording media deciding apparatus.

FIG. 1 is a side view of an image forming apparatus 1 including a recording media deciding apparatus according to the embodiments of the present invention. As shown in FIG. 1, the image forming apparatus 1 has an automatic document feeding unit 11, an image reading portion 12, an image forming portion 13, a transfer portion 14, a recording media conveying mechanism 19 and a paper feeding unit 15.

The automatic document feeding unit 11 is openably provided above the body of the image forming apparatus 1. The automatic document feeding unit 11 has a document conveying mechanism which takes out sheets of a document one by one from a sheet tray, and conveys the document to a discharge tray.

The automatic document feeding unit 11 conveys sheets of a document one by one to a document reading portion of the image reading portion 12 by means of the document conveying mechanism. Further, it is possible to set the document on a platen of the image reading portion 12 after opening the automatic document feeding unit 11.

The image reading portion 12 has a carriage including an exposure lamp which exposes light on the document and a first reflecting mirror, a plurality of second reflecting mirrors engaged with a body frame of the image forming apparatus 1, and a CCD (Charge Coupled Device) of the image reading sensor.

The carriage stays still on the document reading portion or makes a round trip movement under the platen, and light of the exposure lamp reflected by document is reflected by the first reflecting mirror toward the second reflecting mirrors. A plurality of the second reflecting mirrors reflect the reflected light of the first reflecting mirror toward a lens block. The lens block outputs this reflected light to the CCD. The CCD converts the incident light into an electrical signal to output it to the image forming portion 13 as an image signal.

The image forming portion 13 may be an electronic image forming portion or an inkjet image forming portion.

In the case of the electronic image forming portion, the image forming portion 13 has an electrostatic latent image forming portion. The electrostatic latent image forming portion has a laser light radiating unit which radiates laser light based on a command from an image processing portion, a photosensitive drum being an electrostatic latent image bearing body which bears an electrostatic latent image by being applied a voltage and radiated by laser light, and a developer supplying unit which supplies a developer to the electrostatic latent image bearing body.

The electrostatic latent image on the electrostatic latent image bearing body forms a developed image by receiving a supply of a developer.

The image forming apparatus which performs color printing has an electrostatic latent image forming portion for each color of yellow (Y), magenta (M), cyan (C) and black (K).

The image forming portion 13 has a transfer belt 14B to which a developed image is transferred and which bears the developed image, a transfer unit 14A which transfers the developed image on the transfer belt 14B to recording media, and a fixing unit 17 which gives heat and pressure to the recording media to fix the developed image on the recording media.

The transfer unit 14A changes a transfer voltage based on a command from the controller. When the transfer voltage is higher, a more developer is transferred to recording media. When the transfer voltage is lower, a less developer is transferred to the recording media.

In the case of the inkjet image forming portion, the image forming portion 13 has an ink supplying unit and an inkjet head which sprays the supplied ink.

With the inkjet head, piezo elements of different polarities are pasted and these piezo elements are arranged in a comb shape. Electrodes are arranged in respective piezo elements. Further, a sealing having a spraying nozzle for spraying an ink is arranged on an upper end of the piezo element.

The voltage is applied to the piezo element through the electrode. When the voltage is applied, the piezo element deforms, and sucks an ink to discharge it from the spraying nozzle to the recording media.

A contrast of images to be formed is determined based on the degree of the voltage to be applied, voltage duty and feeding speed of the recording media.

The recording media conveying mechanism 19 has a pickup mechanism 15A which takes out the recording media one by one in the uppermost stream on the side of the paper feeding unit 15.

The pickup mechanism 15A takes out the recording media one by one from the paper feeding unit 15 to pass the media to the recording media conveying mechanism 19. The recording media conveying mechanism 19 conveys the recording media to the transfer portion 14.

In addition, according to another embodiment of the image forming apparatus 1, the developer is transferred directly to the recording media from the photosensitive drum. In this case, the transfer roller 14A is arranged to face the photosensitive drum.

Recording media P discharged from a discharge slot are stacked on the discharge tray 16 being a bearing portion which bears the recording media.

Further, the image forming apparatus 1 has a recording media deciding apparatus 100 in the paper feeding unit 15. The recording media deciding apparatus 100 has a light radiating portion 102 which radiates light from the first surface to the bundle of recording media, a light detecting portion 103 which detects light emitted from the second surface different from the first surface of the bundle of recording media, and a controller 101 which decides on the type of recording media based on a signal output from the light detecting portion 103.

When there are a plurality of paper feeding units 15, the light radiating portion 102 and the light detecting portion 103 are arranged on each of the paper feeding units 15.

The light radiating portion 102 is arranged, for example, above the paper feeding units 15. When recording media cassettes are mounted, recording media are lifted upward and abut on the pickup roller. The light radiating portion 102 abuts on the uppermost surface of the bundle of the recording media lifted, and is arranged to radiate light toward the interior of the bundle of the recording media from the uppermost surface of the bundle of the recording media.

The light radiating portion 102 may be arranged in the bottom surface of the paper feeding unit 15. In this case, the light radiating portion 102 abuts on the lowermost surface of the bundle of the recording media, and is arranged to radiate light toward the interior of the bundle of the recording media from the lowermost surface of the bundle of the recording media.

The light detecting portion 103 is arranged toward, for example, the lateral surface of the bundle of the recording media. The light detecting portion 103 can use, for example, an area sensor in which CMOS image sensors are aligned two-dimensionally. The light detecting portion 103 can use a sensor which can detect a wavelength of light radiated by the light radiating portion 102.

First Embodiment

Figure 2:
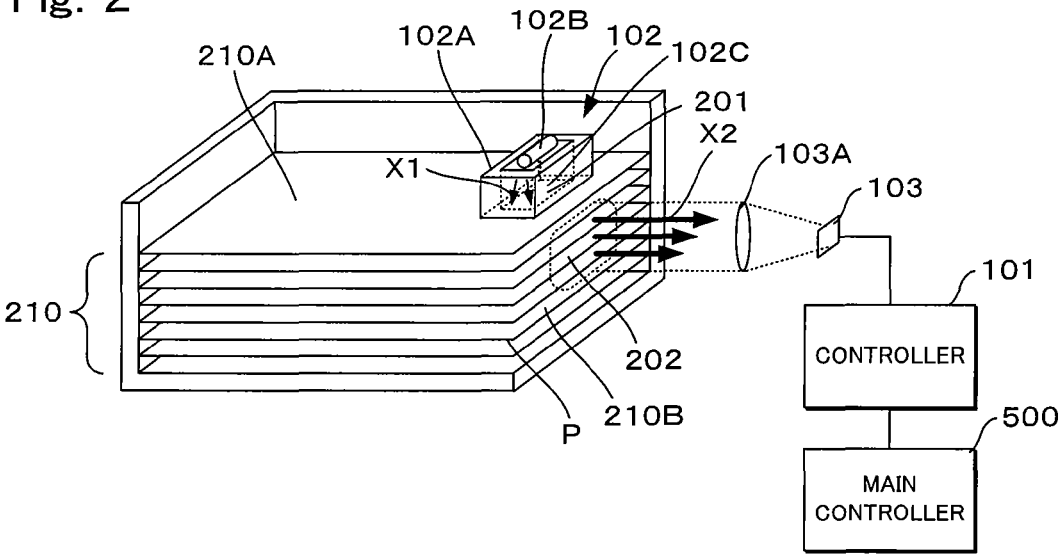
FIG. 2 is a view illustrating arrangement and a configuration of a recording media deciding apparatus according to the first embodiment.

FIG. 2 is a view illustrating arrangement and a configuration of the recording media deciding apparatus 100 according to a first embodiment. As illustrated in FIG. 2, the light radiating portion 102 is arranged abutting on an uppermost surface 210A which is the first surface of a bundle 210 of recording media P.

The light radiating portion 102 has a light source 102B which radiates light and a light shielding portion 102A which limits a radiation range of the light radiated by the light source 102B with respect to the bundle 210 of the recording media P.

The light shielding portion 102A has an inner space penetrating the bottom surface, and has the light source 102B in the interior of this inner space.

The light shielding portion 102A has a slit 102C through which light passes toward the bottom surface. Light radiated from the light source 102B is reflected by the interior of the light shielding portion 102A, is radiated from the slit 102C, and reaches a radiation range 201 of the bundle 210 of the recording media P.

The light having reached the radiation range 201 enters the interior of the bundle 210 of the recording media P. The light transmits through, is reflected by and attenuated by the recording media. Part of the light is emitted in the direction shown by an arrow X2 from the lateral surface 210B which is the second surface different from the first surface of the bundle 210 of the recording media P.

The light detecting portion 103 concentrates and detects a portion of the emitted light in the detection range 202 by means of the lens 103A.

The light detecting portion 103 converts the detected light into an electrical signal to output it to a controller 101. The controller 101 decides on some data such as the type, thickness and density of the recording media based on the output from the light detecting portion 103 to output the data to a main controller 500.

The main controller 500 optimizes an image forming, method based on the output from the controller 101.

Figure 3:
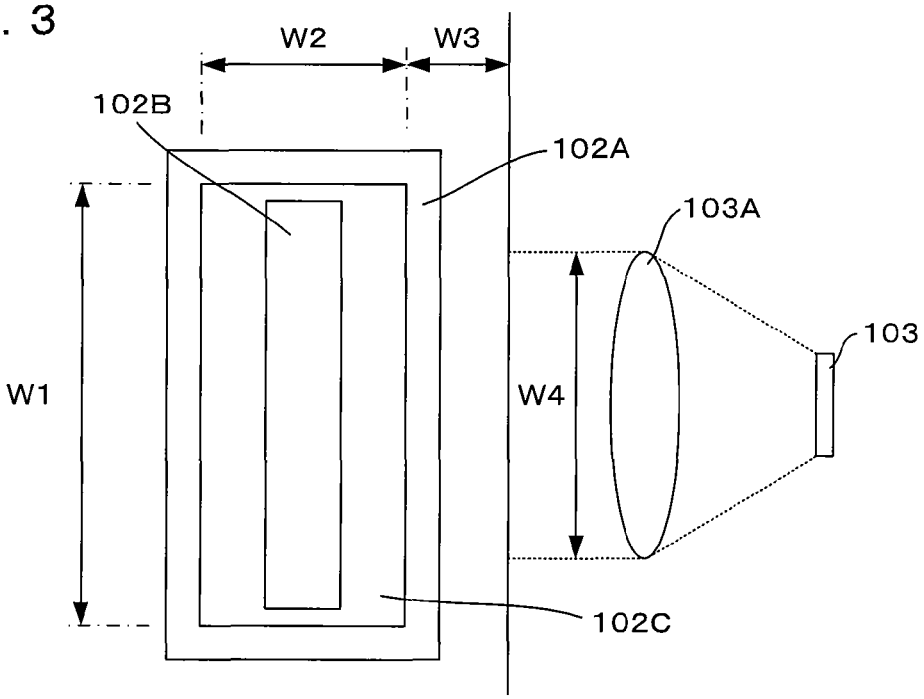
FIG. 3 is a plan view of the recording media deciding apparatus.

FIG. 3 is a plan view of the recording media deciding apparatus 100. As shown in FIG. 3, a length W1 of the slit 1020 in a direction parallel to an image capturing plane of the light detecting portion 103 is longer than a range W4 of the detection range 202 of the light detecting portion 103 in the horizontal direction.

The light radiating portion 102 is arranged such that the detection range 202 in the horizontal direction is entirely included in the radiation range 201 in the horizontal direction.

The light source 102B is preferably a linear light source such as a fluorescent lamp formed linearly. The light source 102B preferably includes near-infrared light in its illuminated light. This is because recording media attenuate light more moderately than visible wavelengths.

The linear light source 102B is arranged parallel to the side of the recording media P on the detection range 202 side. Hence, the light source 102B does not produce unevenness of the light intensity in the radiation range 201.

The linear light source 102B is arranged such that light is uniform, that is, the light intensity is equal to or more than the first threshold and equal to or less than the second threshold, in the range W4 of the detection range 202 of the light detecting portion 103 in the horizontal direction.

According to the present embodiment, for example, the length W1 is 10 mm, the range W4 is 5 mm, a width W2 of the slit 102C is 4 mm, and a distance W3 between the inner side of the slit 102C and the side of the recording media P on the detection range 202 side is 1 mm.

Figure 4:
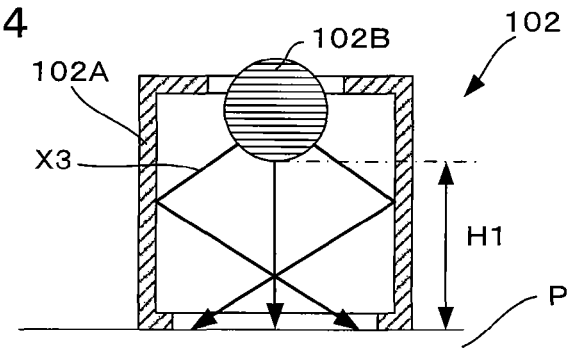
FIG. 4 is a side sectional view of a light radiating portion.

FIG. 4 is a side sectional view of the light radiating portion 102. As shown in FIG. 4, the light source 102B is positioned at a height H1 from the recording media P. The height H1 is preferably equal to or more than 0 mm and equal to or less than 10 mm. With the present embodiment, the height H1 is 5 mm.

The light radiated by the light source 102B is reflected in the interior of the light shielding portion 102A as illustrated by an arrow X3, and reaches the recording media P.

Figure 5:
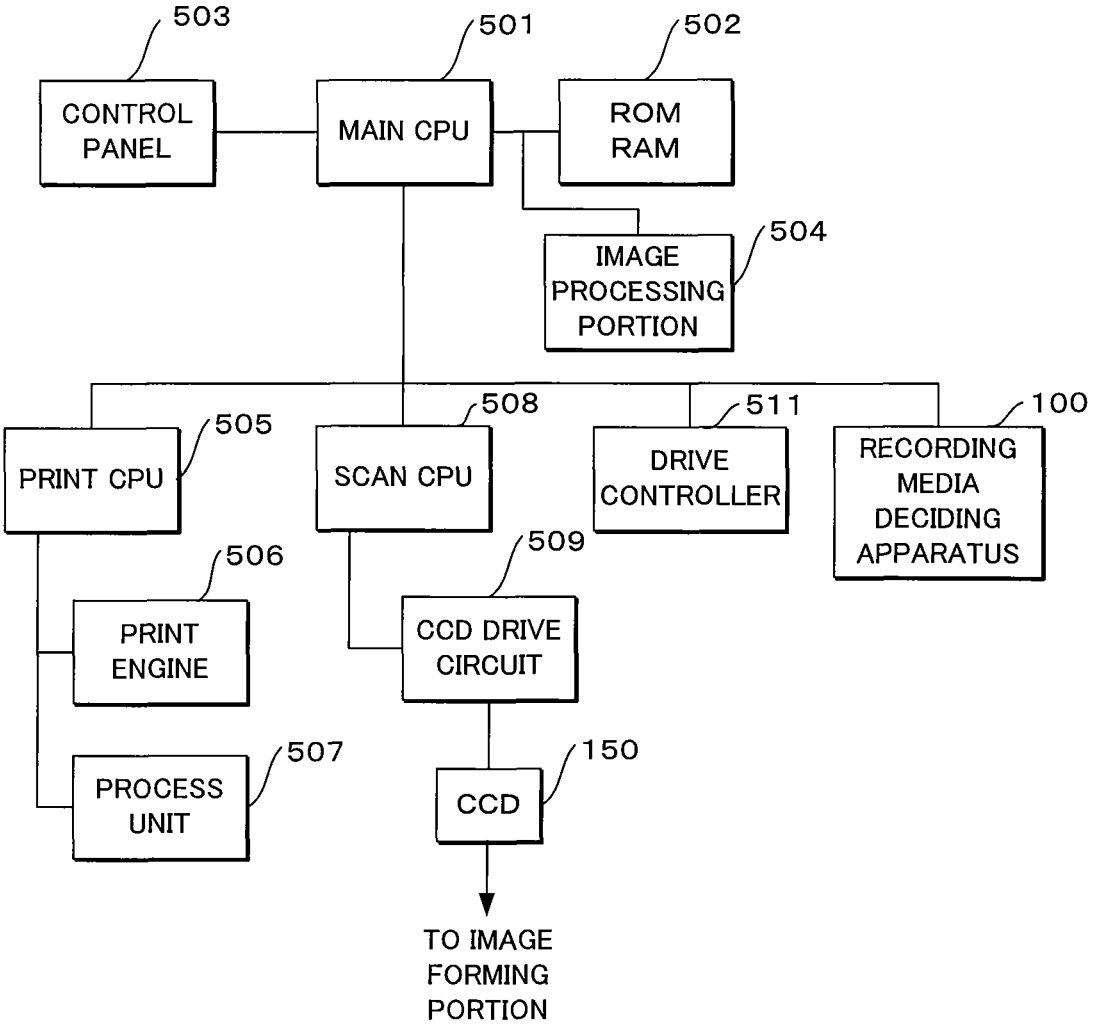
FIG. 5 is a block diagram illustrating a configuration of an image forming apparatus including a recording media deciding apparatus.

FIG. 5 is a block diagram illustrating a configuration of an image forming apparatus 1 having the recording media deciding apparatus 100. As illustrated in FIG. 5, the image forming apparatus 1 has a main CPU 501 which is a main controller integrally controlling the image forming apparatus 1, a control panel 503 which is a display inputting apparatus, a ROM/RAM 502 which is a storing device and an image processing portion 504 which performs image processing.

The main CPU 501 connects to and controls a print CPU 505, a scan CPU 508, a driving controller 511, and a recording media deciding apparatus 100 provided in the image forming apparatus 1.

The print CPU 505 connects to and controls a print engine 506 which forms images and a process unit 507 which includes a transfer unit and the fixing unit 17.

The scan CPU 508 controls a CCD driving circuit 509 which drives a CCD 150. The output from the CCD 150 is output to the image forming portion.

The driving controller 511 controls the driving unit which conveys recording media.

Figure 6:
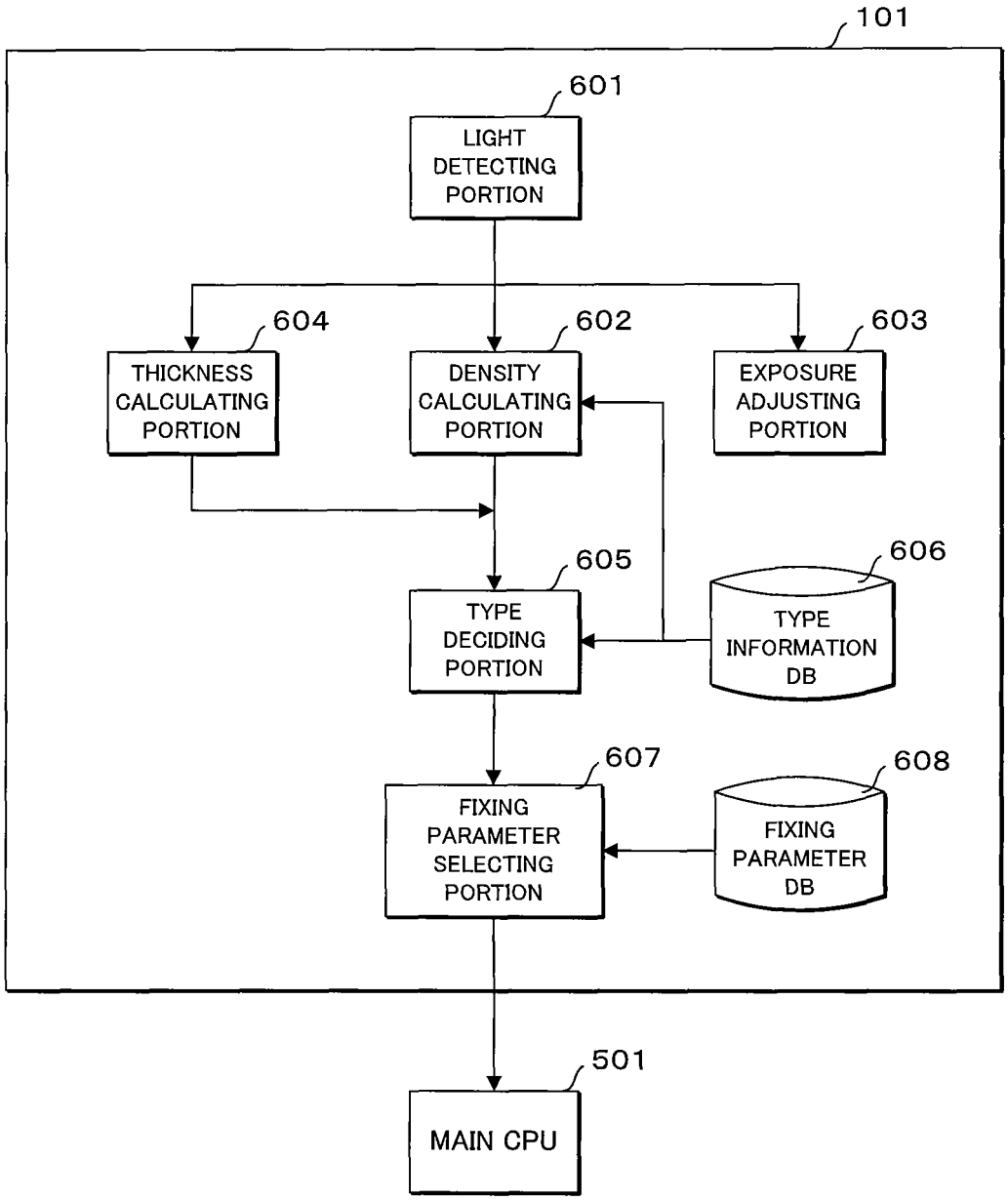
FIG. 6 is a block diagram illustrating a configuration of a controller of the recording media deciding apparatus.

FIG. 6 is a block diagram illustrating a configuration of the controller 101 of the recording media deciding apparatus 100. As shown in FIG. 6, the controller 101 has a light detecting portion 601 which receives an output from the light detecting portion 103, an exposure adjusting portion 603 which outputs a signal for adjusting exposure of the light detecting portion 103 to the light detecting portion 103, a thickness calculating portion 604 which calculates the thickness of recording media based on the output from the light detecting portion 601, a type information database (hereinafter, the database will be referred to as "DB".) 606 which stores information related to the type of recording media, a density calculating portion 602 which calculates the density of recording media based on the output from the light detecting portion 601 and information related to the type of recording read from the type information DB 606, a type deciding portion 605 which decides on the type of recording media based on the outputs from the density calculating portion 602 and thickness calculating portion 604 and information related to the type of recording media read from the type information DB 606, a fixing parameter DB 608 which stores an operation parameter of the fixing unit 17, and a fixing parameter selecting portion 607 which selects the operation parameter of the fixing unit 17 based on the output from the type deciding portion 605 and the operation parameter read from the fixing parameter DB 608 to output the parameter to the main CPU 501.

FIG. 7 is a view illustrating a data configuration of the type information DB 606. As illustrated in FIG. 7, the type information DB 606 stores "type of recording media" indicating a type of recording media, "thickness" indicating a thickness of the recording media, "density" indicating a density of the recording media and "transmission light attenuation rate". In FIG. 7, A11 to C42 respectively indicate constants.

FIG. 8 is a view illustrating a data configuration of the fixing parameter DB 608. As shown in FIG. 8, the fixing parameter DB 608 stores "type of recording media" indicating a type of recording media, "fixing target temperature" which is a target value of a fixing temperature, and "conveying speed" indicating a conveying speed of the recording media. In FIG. 8, D11 to E32 respectively indicate constants.

The light detecting portion 601 calculates a sectional intensity distribution of the light intensity based on the output from the light detecting portion 103. More specifically, the light detecting portion 103 has light receiving elements which detect light, in a two-dimensional and rectangular alignment. The light detecting portion 601 sequentially adds the light intensity of image data captured by the light detecting portion 103, in a direction parallel to the printing plane of sheets, and calculates an average value of the light intensity by dividing the addition result by the number of pixels. The average value of the light intensity is calculated to reduce an impact by noise.

The light detecting portion 601 calculates a sectional intensity distribution of the light intensity by sequentially calculating the average value of the light intensity in a sheet bundle stacking direction.

The density calculating portion 602 calculates a transmission light attenuation rate from the sectional intensity distribution of the light detecting portion 601, and reads the density of the recording media from the type information DB 606 based on the transmission light attenuation rate. More specifically, the density calculating portion 602 acquires a minimum value in a valley between peaks of the sectional intensity distribution, and decides on curve $f(x)=\exp^{(-ax)}$ which passes the minimum value. Using a constant "a" of the decided f(x) as the transmission light attenuation rate, the density calculating portion 602 decides on a corresponding type of recording media by searching in the type information DB 606 based on the transmission light attenuation rate. Any equation of f(x) may be used as long as this equation can find the transmission light attenuation rate.

The density calculating portion 602 decides whether or not the light amount radiated by the light source 102B of the light radiating portion 102 is optimal, based on the output from the light detecting portion 103. When, for example, the output from the light detecting portion 103 is represented by 256 levels and the number of pixels exceeding an upper limit value, i.e. 250, exceeds 10% of the entire pixels, the density calculating portion 602 decides that the light source 102B is over-exposed. When the number of pixels below a lower limit value, i.e. 10, exceeds 20% of the entire pixels, the density calculating portion 602 decides that the light source 102B is under-exposed.

The density calculating portion 602 outputs to the exposure adjusting portion 603 a signal of increasing the shutter speed of the light detecting portion 103 when deciding that the light source 102B is over-exposed, and outputs a signal of delaying the shutter speed of the light detecting portion 103 when deciding that the light source 102B is under-exposed.

The thickness calculating portion 604 calculates the number of pixels between adjacent peaks of the sectional intensity distribution of the light detecting portion 601, and calculates the thickness of recording media based on the number of pixels and the size of one pixel calculated in advance.

The type deciding portion 605 reads the type of the recording media from the type information DB 606 based on the density input from the density calculating portion 602 and the thickness input from the thickness calculating portion 604 to output the read type to the fixing parameter selecting portion 607. Then, the type deciding portion 605 may read the type of recording media which is expected to be highly probable even if one of the density data and thickness data can only be obtained.

The fixing parameter selecting portion 607 reads the fixing target temperature and the conveying speed from the fixing parameter DB 608, based on the type of recording media, to output the temperature and the speed to the main CPU 501.

In addition, the fixing parameter DB 608 may further store information related to the density, and the fixing parameter selecting portion 607 may read the fixing target temperature and conveying speed from the fixing parameter DB 608, based on the type and density of the recording media, to output the temperature and the speed to the main CPU 501.

The fixing parameter DB 608 may store information related to a transfer bias, and the fixing parameter selecting portion 607 may read information related to the transfer bias from the fixing parameter DB 608, based on the type and density of the recording media, to output the information to the main CPU 501.

Figure 9:
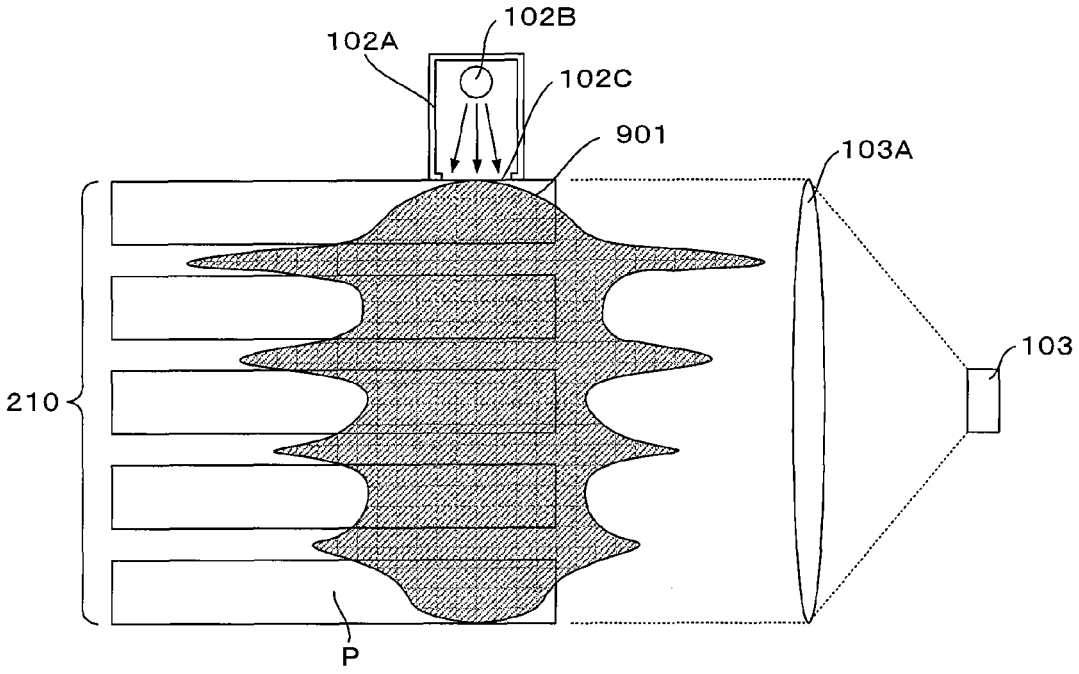
FIG. 9 is a side view illustrating how light radiated from the light radiating portion transmits through the interior of the bundle of recording media.
Figure 10:
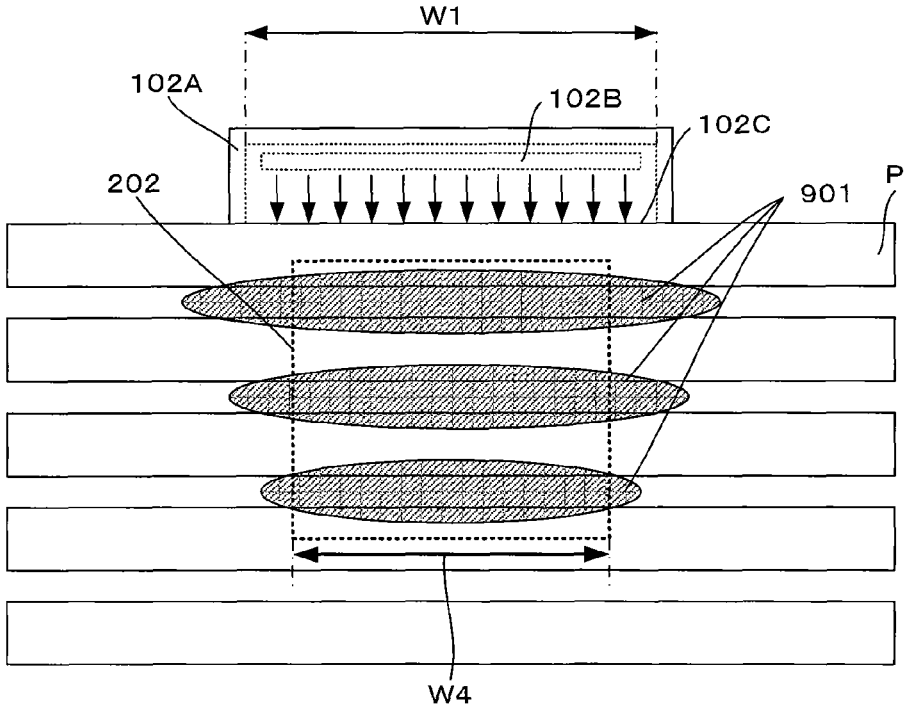
FIG. 10 is a view illustrating how light radiated from the light radiating portion transmits through the interior of the bundle of recording media seen from a light detecting portion.

FIG. 9 is a side view illustrating how light radiated from the light radiating portion 102 transmits through the interior of the bundle 210 of the recording media. FIG. 10 is a view illustrating how the light radiated from the light radiating portion 102 transmits through the interior of the bundle 210 of recording media seen from the light detecting portion 103.

As shown in FIG. 9, the light source 102B is accommodated inside the light shielding portion 102A which has, in the bottom surface, the slit 102C which allows light to pass through. Hence, light radiated from the light source 102B is not directly incident on the light detecting portion 103.

Transmission light 901 transmits while being attenuated by the stacked recording media P, and the light having transmitted through the interior of the recording media P is output from the lateral surface and reaches the light detecting portion 103. Further, between the adjacent recording media P, the transmission light 901 repeats reflection and reaches the light detecting portion 103.

Consequently, an intensity of the light emitted from the adjacent recording media P is stronger than an intensity of the light emitted passing through the interior of the recording media P. Therefore, the distance between adjacent peaks of the sectional intensity distribution matches the thickness of the recording media.

As shown in FIG. 10, the length W1 of the slit 102C in a direction parallel to the detection range 202 of the light detecting portion 103 is longer than the range W4 of the detection range 202 of the light detecting portion 103 in the horizontal direction.

The light radiating portion 102 is arranged such that the entire range W4 of the detection range 202 in the horizontal direction is included in the radiation range 201 in the horizontal direction.

Consequently, the width of the transmission light 901 emitted from between the recording media P in the horizontal direction is longer than the range W4 of the detection range 202 of the light detecting portion 103 in the horizontal direction. Therefore, unevenness of the light intensity in the horizontal direction is not produced.

Figure 11:
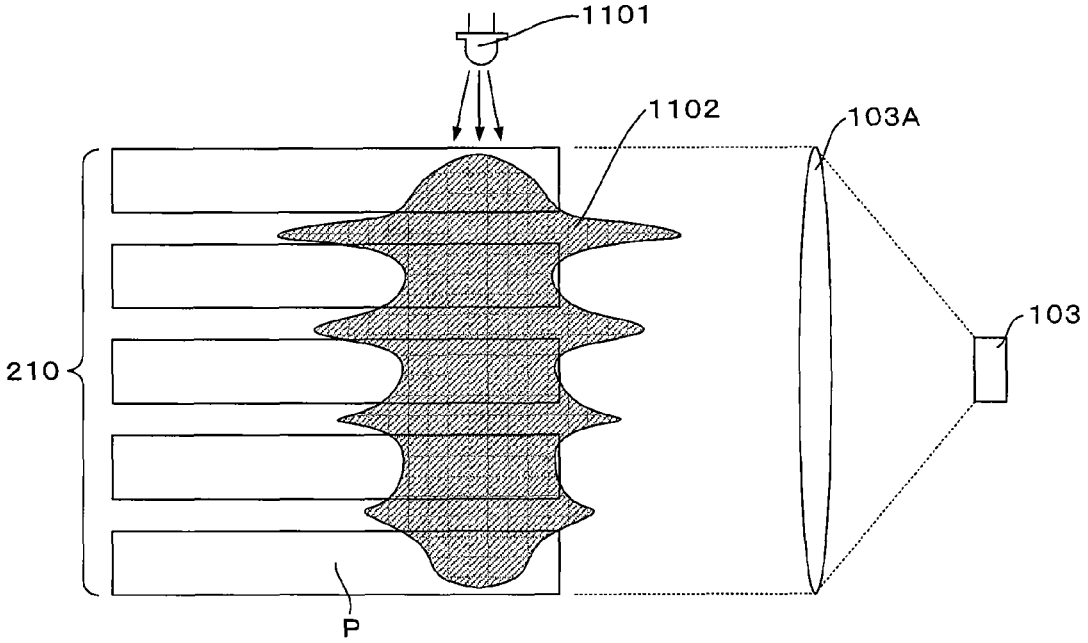
FIG. 11 is a side view illustrating how light radiated in a conventional technique transmits through the interior of the bundle of recording media.
Figure 12:
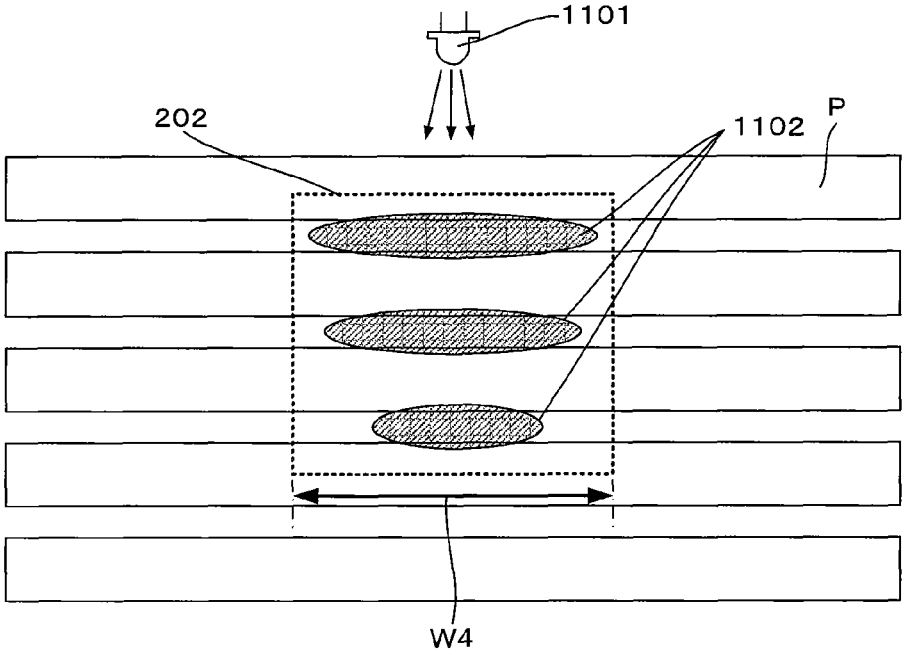
FIG. 12 is a view illustrating how light radiated in a conventional technique transmits through the interior of the bundle of recording media seen from a light detecting portion.

FIG. 11 is a side view illustrating how light radiated in a conventional technique transmits through the interior of the bundle 210 of the recording media. FIG. 12 is a view illustrating how light radiated in a conventional technique transmits through the interior of the bundle 210 of the recording media seen from the light detecting portion 103.

As shown in FIG. 11, a point light emitter such as a single light emitting diode is used for a light source 1101 in a conventional technique. Therefore, the transmission light 1102 is rapidly attenuated in the recording media P.

Further, as shown in FIG. 12, the width of the transmission light 1102 emitted between the recording media P in the horizontal direction is narrower than the range W4 of the detection range 202 of the light detecting portion 103 in the horizontal direction. Therefore, unevenness of the light intensity in the horizontal direction is produced.

Figure 13:
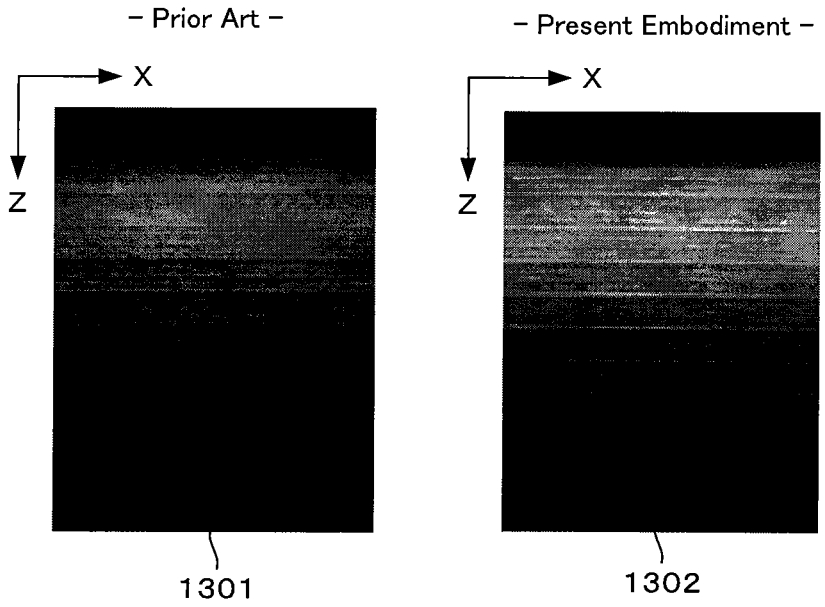
FIG. 13 is a view illustrating an example of images captured by the light detecting portion according to the conventional technique and the present embodiment.

FIG. 13 is a view illustrating an example of images captured by the light detecting portion 103 according to a conventional technique and the present embodiment. In FIG. 13, a photograph 1301 is an example of a captured image according to the conventional technique, and a photograph 1302 is an example of a captured image according to the present embodiment.

As shown in FIG. 13, the captured image according to the present embodiment has more distinctive contrast.

Figure 14:
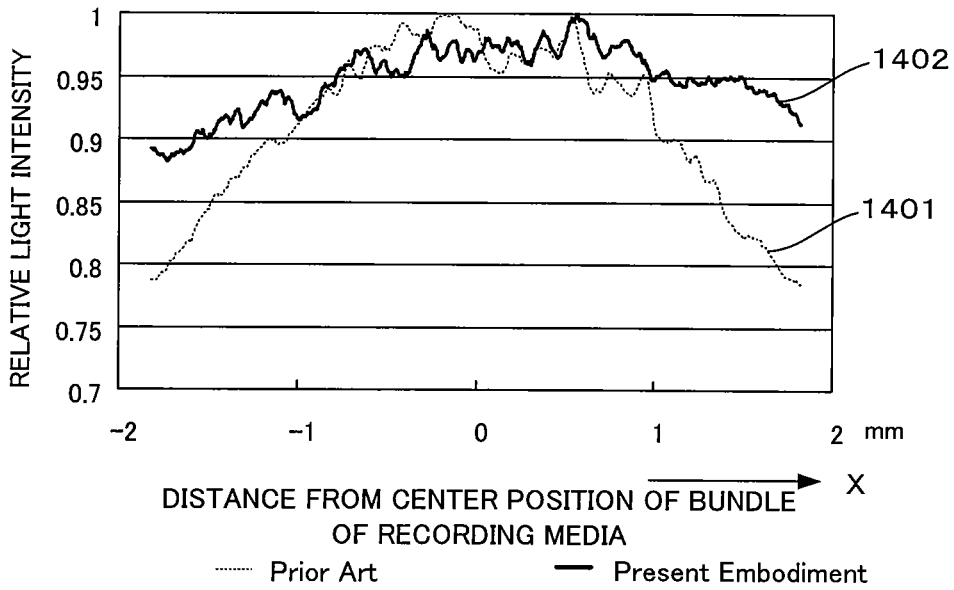
FIG. 14 is a graph showing a sectional intensity distribution in an X direction obtained by finding an average value of a light intensity distribution in images in FIG. 13 in a Z direction.

FIG. 14 is a graph showing a sectional intensity distribution in an X direction obtained by finding an average value of a light intensity distribution in images in FIG. 13 in a Z direction. In FIG. 14, the light source is arranged such that the center of the light source meets the center 0 of the bundle of the recording media. The vertical axis indicates a relative light intensity, the horizontal axis indicates the distance from the center position of the bundle of the recording media, a graph 1401 indicates the conventional technique and the graph 1402 indicates the present embodiment.

As shown in FIG. 14, the light intensity rapidly attenuates as increasingly apart from the center of the bundle of the recording media in the conventional technique. With the present embodiment, the light intensity is maintained even though increasingly apart from the center of the bundle of the recording media.

Figure 15:
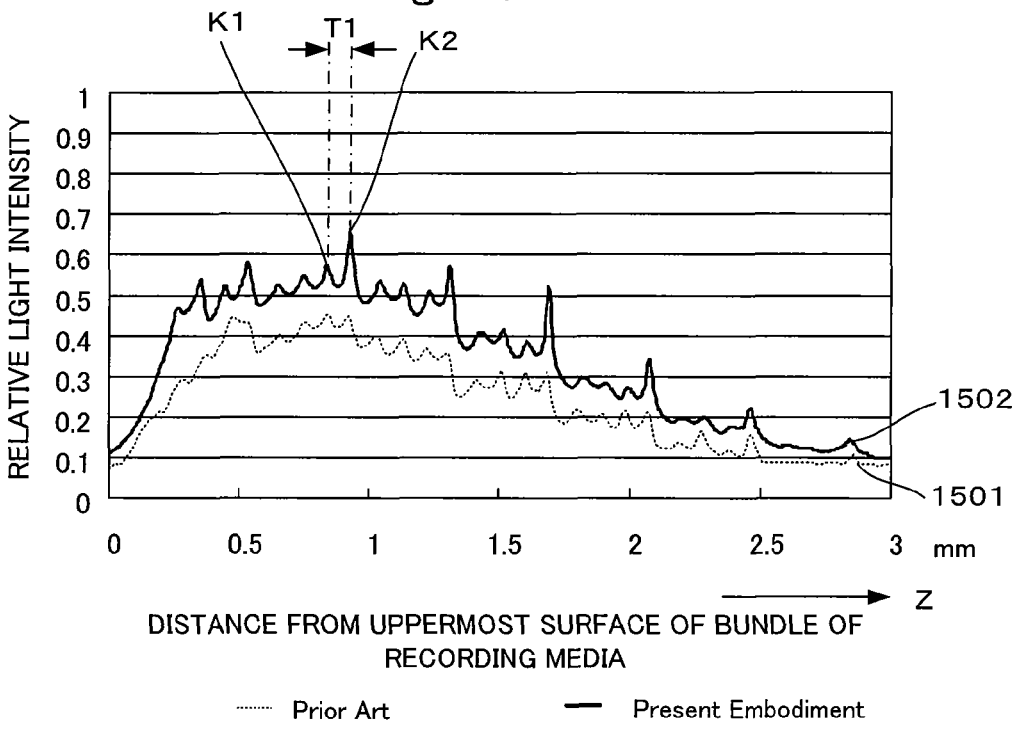
FIG. 15 is a graph showing a sectional intensity distribution in a Z direction obtained by finding an average value of a light intensity distribution in the images of FIG. 13 in an X direction.

FIG. 15 is a graph showing a sectional intensity distribution in the Z direction obtained by finding an average value of a light intensity distribution in the images of FIG. 13 in the X direction. In FIG. 15, the vertical axis indicates a relative light intensity, the horizontal axis indicates the distance from the uppermost surface of the bundle of the recording media, a graph 1501 indicates the conventional technique and the graph 1502 indicates the present embodiment.

As shown in FIG. 15, a rise of the peak according to the present embodiment is more distinctive and is distinctively contrastive. Consequently, it is possible to precisely measure a distance T1 between a peak K1 and a peak K2 which is the thickness of the recording media.

This will be simulated using a couple of formulae below. When the width direction of a recording media end portion is represented by the x axis, depth direction of the recording media is represented by the z axis, the direction away from the recording media end surface is represented by the y axis, the distance from the side of the recording media end portion to the light radiating position is represent by d and the attenuation factor of transmission light by recording media is represented by a, a light amount distribution $I_p$ of transmission light according to the conventional technique is as shown in equation (1) and the light amount distribution $I_l$ of transmission light according to the present embodiment is as shown in equation (2).

$$I_P(z, x) = I_0 \frac{z}{(z^2 + x^2 + d^2)^{\frac{3}{2}}} \exp\left(-a\sqrt{z^2 + x^2 + d^2}\right) \tag{1}$$

$$I_l(z, x) = \int_{-\infty}^{\infty} I_0 \frac{z}{(z^2 + x^2 + d^2)^{\frac{3}{2}}} \exp\left(-a\sqrt{z^2 + x^2 + d^2}\right) dx \tag{2}$$

Equation (1) has a distribution which depends on x, and equation (2) does not depend on x. Consequently, there is no unevenness in the light amount in the x axis direction which is the horizontal direction according to the present embodiment.

As described above, the recording media deciding apparatus 100 according to the present embodiment has the light radiating portion 102 which radiates light having the uniform light amount on the range corresponding to the image capturing range of the first surface of the bundle 210 of the recording media P, the light detecting portion 103 which captures an image of light emitted from the second surface different from the first surface of the bundle 210 of the recording media P, and the controller which decides on the type of the recording media based on the output from the light detecting portion 103. The light radiating portion 102 has the linear light source 102B disposed parallel to the side of the image capturing plane for the bundle 210 of the recording media P.

Consequently, the captured image of the light detecting portion 103 has no unevenness in the horizontal direction, so that it is possible to provide an advantage of more precisely measuring the type of recording media when the recording media are in the recording media supplying unit.

Second Embodiment

The configuration of a recording media deciding apparatus 100 according to a second embodiment is the same as the configuration of the first embodiment other than the light source of the light radiating portion 102.

Figure 16:
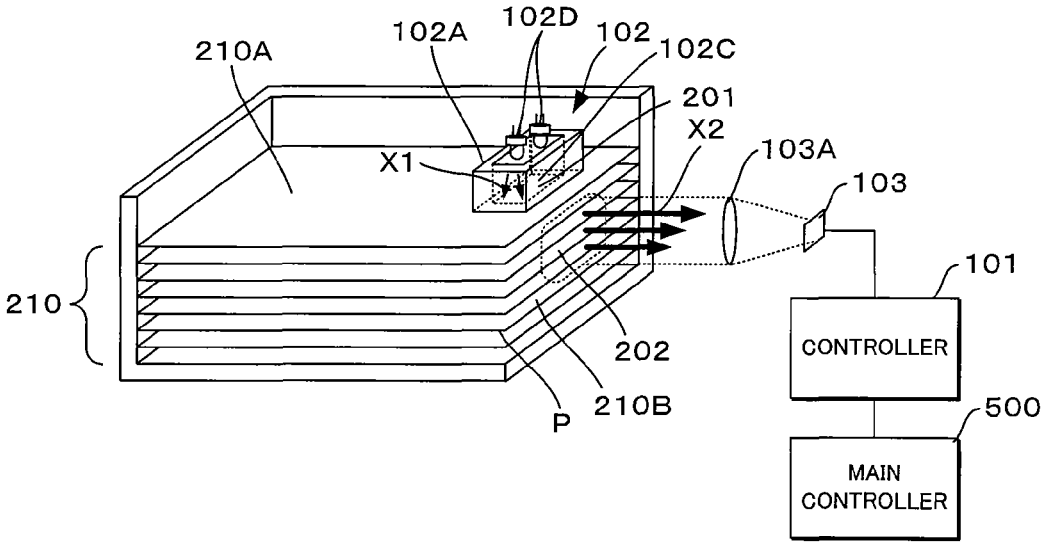
FIG. 16 is a view illustrating arrangement and a configuration of a recording media deciding apparatus according to a second embodiment.

FIG. 16 is a view illustrating arrangement and a configuration of the recording media deciding apparatus 100 according to the second embodiment. As shown in FIG. 16, the recording media deciding apparatus 100 has a plurality of point light sources 102D instead of a linear light source.

For the point light sources 102D, one or more types can be selected from among LED, near-infrared LED, organic EL, and so on. The point light sources 102D preferably include near-infrared light. This is because the near-infrared light is moderately attenuated by recording media.

Figure 17:
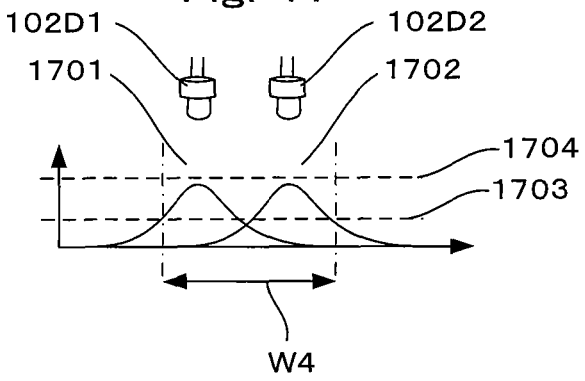
FIG. 17 is a view illustrating arrangement of point light sources.

FIG. 17 is a view illustrating arrangement of the point light sources 102D. In FIG. 17, a graph 1701 indicates the intensity of light radiated from a first point light source 102D1, and a graph 1702 indicates the intensity of light radiated from a second point light source 102D2.

As shown in FIG. 17, the first point light source 102D1 and the second point light source 102D2 are arranged such that their light radiation areas overlap. More specifically, the first point light source 102D1 and the second point light source 102D2 are arranged parallel to the side of the image capturing plane of the light detecting portion 103 for the bundle 210 of the recording media P.

The first point light source 102D1 and the second point light source 102D2 are arranged such that the light intensity is uniform, that is, the light intensity is equal to or more than a first threshold value 1703 and equal to or less than a second threshold value 1704, in the range W4 of an image capturing range of the light detecting portion 103.

When radiating light with the same light amount, the first point light source 102D1 and the second point light source 102D2 have an equal distance from the uppermost surface of the recording media P.

As described above, the recording media deciding apparatus 100 according to the present embodiment has the light radiating portion 102 which radiates light having the uniform light amount on the range corresponding to the image capturing range of the first surface of the bundle 210 of the recording media P by means of a plurality of point light sources 102D, the light detecting portion 103 which captures an image of light emitted from the second surface different from the first surface of the bundle 210 of the recording media P, and the controller which decides on the type of the recording media based on the output from the light detecting portion 103.

Consequently, it is possible to manufacture the recording media deciding apparatus 100 at lower cost.

Third Embodiment

The configuration of a recording media deciding apparatus 100 according to a third embodiment is the same as the configuration of the first embodiment other than the light source of the light radiating portion 102.

Figure 18:
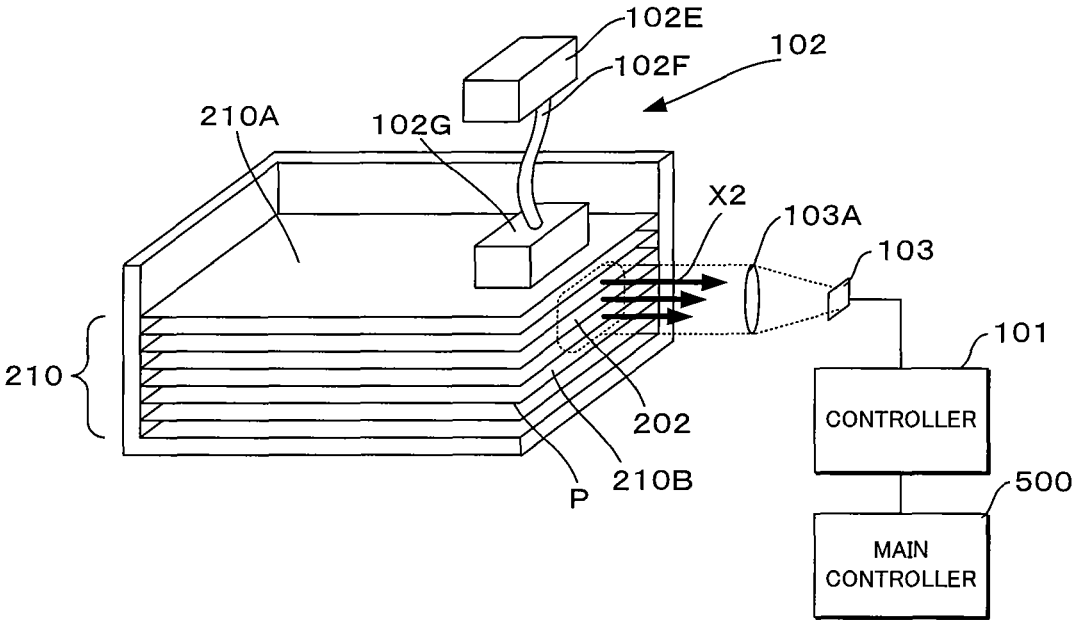
FIG. 18 is a view illustrating arrangement and a configuration of a recording media deciding apparatus according to a third embodiment.

FIG. 18 is a view illustrating arrangement and a configuration of the recording media deciding apparatus 100 according to the third embodiment. As shown in FIG. 18, the recording media deciding apparatus 100 has a laser light source 102E instead of a linear light source, optical fibers 102F which guide light emitted by the laser light source 102E and a fixing unit 102G in which the optical fibers 102F are linearly arranged and fixed.

Figure 19:
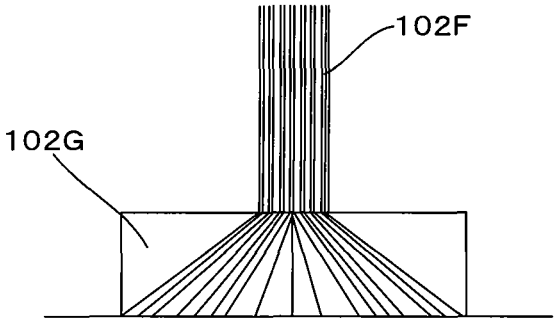
FIG. 19 is a sectional view near a fixing unit for optical fibers.
Figure 20:
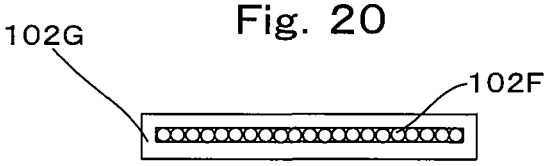
FIG. 20 is a view illustrating the fixing unit for optical fibers seen from a recording media direction.

FIG. 19 is a sectional view near the fixing unit 102G for the optical fibers. FIG. 20 is a view illustrating the fixing unit 102G for the optical fibers seen from the direction of recording media P.

As shown in FIGS. 19 and 20, the optical fibers 102F which are linearly arranged radiate laser light toward a bundle 210 of the recording media P.

Figure 21:
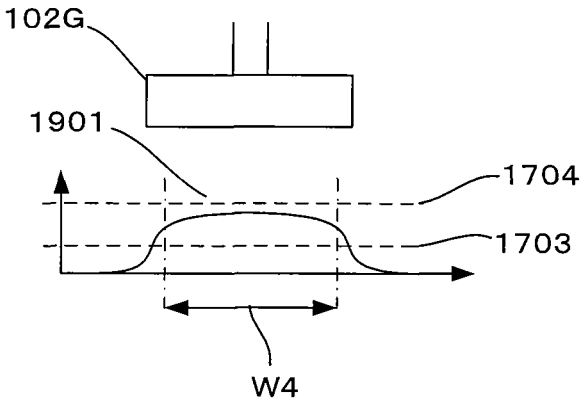
FIG. 21 is a view illustrating arrangement of the fixing unit for optical fibers.

FIG. 21 is a view illustrating arrangement of the fixing unit 102G for the optical fibers. In FIG. 21, a graph 1901 indicates an intensity of light radiated from the optical fibers 102F.

As shown in FIG. 21, front ends of respective optical fibers 102F are arranged in the fixing unit 102G such that the their light radiation areas overlap. More specifically, the straight line connecting the front end of each optical fiber 102F is arranged parallel to the side of the image capturing plane of a light detecting portion 103 for the bundle 210 of the recording media P.

The front end of each optical fiber 102F is arranged such that the light intensity is uniform, that is, the light intensity is equal to or more than a first threshold value 1703 and equal to or less than a second threshold value 1704, in a range W4 of an image capturing range of the light detecting portion 103.

When radiating light with the same light amount, each optical fiber 102F has the equal distance from the uppermost surface of the recording media P.

As described above, the recording media deciding apparatus 100 according to the present embodiment has the light radiating portion 102 which radiates, by the optical fiber 102F, light having the uniform light amount on the range corresponding to the image capturing range of the first surface of the bundle 210 of the recording media P, the light detecting portion 103 which captures an image of light emitted from the second surface different from the first surface of the bundle 210 of the recording media P, and a controller which decides on the type of the recording media based on the output of the light detecting portion 103 The light radiating portion 102 has a linear light source 102B parallel to the side of the image capturing plane of the bundle 210 of the recording media P.

Consequently, the outline of the range of light to be radiated is clearer, so that it is possible to more precisely decide on the type of recording media.

Another Embodiment

Figure 22:
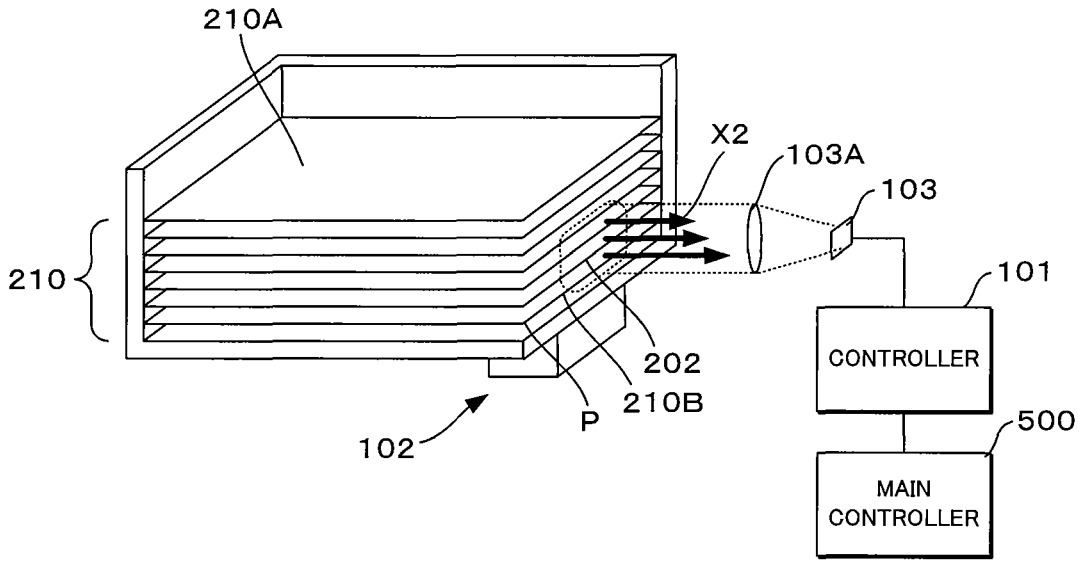
FIG. 22 is a view illustrating an example where a light radiating portion is arranged in a bottom surface of a paper feeding unit.

FIG. 22 is a view illustrating an example where a light radiating portion 102 is arranged in a bottom surface of a paper feeding unit 15. As shown in FIG. 22, it is also possible to arrange the light radiating portion 102 in the bottom surface of the paper feeding unit 15. In this case, the housing of the paper feeding unit 15 and a light shielding portion 102A may also be used in combination.

Figure 23:
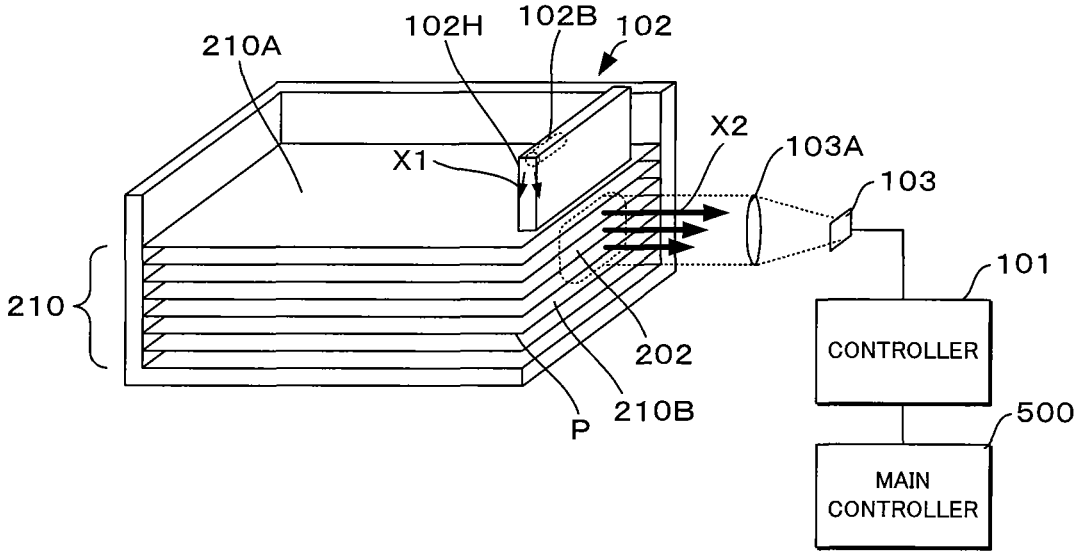
FIG. 23 is a view illustrating an example using a light shielding wall for a light shielding portion.

FIG. 23 is a view illustrating an example using a light shielding wall 102H for the light shielding portion 102A. As shown in FIG. 23, the light shielding plate 102A may have a plate shape. In this case, the light shielding wall 102H is arranged in a position where light from a light source 102B does not directly reach a light detecting portion 103.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A recording media deciding apparatus comprising:

a light radiating portion configured to radiate light on a first surface of a bundle of recording media, the light radiating portion including:

a linear light source, and a light shielding portion housing the linear light source, having a bottom portion configured to contact the first surface, and having a slit in the bottom portion through which the light radiated from the linear light source passes;

a light detecting portion configured to capture an image of the light reflected from a second surface different from the first surface of the bundle of the recording media; and a controller configured to determine a type of the recording media based on an output of the light detecting portion.

2. The recording media deciding apparatus according to claim 1, wherein the light radiating portion radiates light comprising a light intensity equal to or more than a first threshold value and equal to or less than a second threshold value on a range corresponding to the image capturing range of the first surface of the bundle of the recording media.

3. The recording media deciding apparatus according to claim 1, wherein the light shielding portion prevents the light radiated from the linear light source from directly being incident on the light detecting portion.

4. The recording media deciding apparatus according to claim 1, wherein the linear light source is parallel to the second surface of the recording media.

5. The recording media deciding apparatus according to claim 4, wherein a longitudinal direction of the slit is parallel to the second surface.

6. The recording media deciding apparatus according to claim 5, wherein a length of the slit in the longitudinal direction is longer than a horizontal dimension of a detection area of the light detecting portion.

7. The recording media deciding apparatus according to claim 1, wherein:

the linear light source comprises a plurality of point light sources, and the light shielding portion prevents the light radiated from the point light sources from directly being incident on the light detecting portion.

8. The recording media deciding apparatus according to claim 7, wherein each of the point light sources is positioned an equal distance from the first surface.

9. An image forming apparatus comprising:

a recording media supplying unit configured to supply recording media;

a recording media conveying mechanism configured to supply the recording media supplied from the recording media supplying unit;

an image forming portion configured to form an image on the recording media;

a light radiating portion configured to radiate light on a first surface of a bundle of recording media, the light radiating portion including:

a linear light source, and a light shielding portion housing the linear light source, having a bottom portion configured to contact the first surface, and having a slit in the bottom portion through which the light radiated from the linear light source passes;

a light detecting portion configured to capture an image of the light reflected from a second surface different from the first surface of the bundle of the recording media; and a controller configured to determine a type of the recording media based on an output of the light detecting portion.

10. The image forming apparatus according to claim 9, wherein the light shielding portion prevents the light radiated from the linear light source from directly being incident on the light detecting portion.

11. The image forming apparatus according to claim 9, wherein the linear light source is parallel to the second surface of the recording media.

12. The image forming apparatus according to claim 9, wherein:

the linear light source comprises a plurality of point light sources, and the light shielding portion prevents the light radiated from the point light sources from directly being incident on the light detecting portion.

13. The image forming apparatus according to claim 12, wherein each of the point light sources comprise an equal distance from the first surface.

14. The image forming apparatus according to claim 13, wherein a longitudinal direction of the slit is parallel to the second surface.

15. The image forming apparatus according to claim 14, wherein a length of the slit in the longitudinal direction is longer than a horizontal dimension of a detection area of the light detecting portion.

16. A recording media deciding method comprising:

radiating light on a first surface of a bundle of recording media with a light radiating portion that includes:

a linear light source, and a light shielding portion housing the linear light source, having a bottom portion configured to contact the first surface, and having a slit in the bottom portion through which the light radiated from the linear light source passes;

capturing an image of the light reflected from a second surface different from the first surface of the bundle of the recording media; and determining a type of the recording media based on the captured image.

17. The recording media deciding method according to claim 16, wherein the radiated light is prevented from directly being incident on a light detecting portion by the light shielding portion.

18. The recording media deciding method according to claim 17, wherein the linear light source comprises a plurality of point light sources, each of which are positioned an equal distance from the first surface.

19. The recording media deciding method according to claim 17, wherein a longitudinal direction of the slit is parallel to the second surface.

20. The recording media deciding method according to claim 19, wherein a length of the slit in the longitudinal direction is longer than a horizontal dimension of a detection area of the light detecting portion.

* * * * *